US006620268B2

(12) United States Patent
Cho et al.

(10) Patent No.: US 6,620,268 B2
(45) Date of Patent: Sep. 16, 2003

(54) ENERGETIC PLASTICIZER COMPRISING EUTETIC MIXTURE OF BIS (2,2-DINITROPROPYL) FORMAL, 2,2-DINITROPROPYL 2,2-DINITROBUTYL FORMAL AND BIS (2,2-DINITROBUTYL) FORMAL, AND PREPARATION METHOD THEREOF

(75) Inventors: Jin Rai Cho, Daejon (KR); Jin Seuk Kim, Daejon (KR); Keun Deuk Lee, Daejon (KR); Young Gu Cheun, Daejon (KR); Bang Sam Park, Daejon (KR)

(73) Assignee: Agency For Defense Development, Daejon (KR)

( * ) Notice: Subject to any disclaimer, the term of this patent is extended or adjusted under 35 U.S.C. 154(b) by 81 days.

(21) Appl. No.: 09/808,379

(22) Filed: Mar. 14, 2001

(65) Prior Publication Data

US 2001/0030009 A1 Oct. 18, 2001

(30) Foreign Application Priority Data

Apr. 10, 2000 (KR) ..... 2000-18625

(51) Int. Cl.[7] ..... C06B 25/00
(52) U.S. Cl. ..... 149/88
(58) Field of Search ..... 149/88

(56) References Cited

U.S. PATENT DOCUMENTS 3,526,667 A 9/1970 Hill et al.
4,594,430 A 6/1986 Grakauskas et al.
4,997,499 A 3/1991 Adolph
5,449,835 A * 9/1995 Hamilton et al. ..... 568/590
5,540,794 A 7/1996 Willer et al.
5,648,556 A 7/1997 Hamilton et al.

OTHER PUBLICATIONS

Derwent Publications Ltd. XP–002192685.
United States Statutory Invention Registration, Registration No.: H350, Published: Oct. 6, 1987, Issued to: Adolph, et al.

* cited by examiner

*Primary Examiner*—John Hardee
(74) *Attorney, Agent, or Firm*—Scully, Scott, Murphy & Presser

(57) ABSTRACT

An energetic plascitizer comprising bis(2,2-dinitropropyl) formal, 2,2-dinitropropyl 2,2-dinitrobutyl formal and bis 2,2-dinitrobutyl) formal in a molar ratio of 20~68%/28~50%/4~30% is, described. It is also provided a method for synthesizing the plasticizer comprising: dissolving 2,2-dinitropropanol and 2,2-dinitrobutanol into an organic solvent to form an organic solution, in which the molar ratio of 2,2-dinitropropanol to 2,2-dinitrobutanol is 3:1–6:1; adding to the organic solution a sulfuric acid solution where formaldehyde source was dissolved, wherein the temperature of reaction medium is maintained below 20° C.; and separating and purifying the product from the reaction mixture.

The plascitizer according to the present invention has an excellent thermal and chemical properties while incurring a low production cost. Especially, the energy content of the plasticizer of the present invention is heightened by minimizing the content of the diformal generated as a side product, so that it is favorably adapted for use in an insensitive high performance explosive and a propellant.

6 Claims, No Drawings

ENERGETIC PLASTICIZER COMPRISING EUTETIC MIXTURE OF BIS (2,2-DINITROPROPYL) FORMAL, 2,2-DINITROPROPYL 2,2-DINITROBUTYL FORMAL AND BIS (2,2-DINITROBUTYL) FORMAL, AND PREPARATION METHOD THEREOF

FIELD OF THE INVENTION

The present invention relates to an energetic plasticizer comprising eutectic mixture of mixed-formals for use in an insensitive high performance explosive and propellant, and a preparation method thereof.

BACKGROUND OF THE INVENTION

Bis (2,2-dinitropropyl) formal (BDNPF) is a potent plasticizer used in an insensitive high performance explosive and propellant. However, it has an inherent disadvantage that it is solid at room temperature such that it can not be independently used. Thus, as a plasticizer, an eutectic mixture of BDNPF with its homologue is used.

U.S. Pat. No. 5,648,556 disclosed a plasticizer comprising an eutectic mixture of BDNPF/A, bis(2,2-dinitropropyl) formal/acetal, in which BDNPA keeps BDNPF from crystallizing out. The plasticizer comprising an eutectic mixture of BDNPF/A has been commercially available and wildly used in an explosive and a propellant. But, it is well known that thermal/chemical stability of an acetal group in the BDNPA is lower than that of the formal group in the BDNPF.

U.S. Pat. No. 4,997,499 disclosed a 2-components mixed-formal, BDNPF and 2,2-dinitropropyl 2,2-dinitrobutyl formal (DNPBF), in which DNPBF was used as an inhibitor of crystallization of BDNPF. The 2-components mixed-formal is obtained by reacting a mixture of 2,2-dinitropropanol and 2,2-dinitrobutanol with formaldehyde, but it is also known that about 10% of bis(2,2-dinitropropyl) diformal is always produced as an unfavorable side product.

The 2-components mixed-formal is believed to be superior to the BDNPF/A in terms of the thermal and chemical properties and cost involved. Nevertheless, it has never been realized in the formulation of an explosive and a propellant. It is expected that this is resulted from the difficulty of process and the side product yielded unfavorably in an amount of about 10%.

SUMMARY OF THE INVENTION

Therefore, it is an object of the present invention to provide an improved energetic plasticizer having excellent thermal and chemical properties as well as being economic.

Another object of the present invention is to provide a method for preparing the plasticizer.

To achieve these and other advantages and in accordance with the purpose of the present invention, as embodied and broadly described herein, there is provided an energetic plasticizer comprising an eutectic mixture of bis(2,2-dinitropropyl) formal, 2,2-dinitropropyl 2,2-dinitrobutyl formal and bis(2,2-dinitrobutyl) formal. The plasticizer of the present invention has the following merits: its production cost is low and its thermal and chemical stability is excellent, while it has an energy potent similar to those of conventional plasticizers.

DETAILED DESCRIPTION OF THE INVENTION

The present invention relates to an energetic plasticizer comprising an eutetic mixture of bis(2,2-dinitropropyl) formal, 2,2-dinitropropyl 2,2-dinitrobutyl formal and bis(2,2-dinitrobutyl) formal. The preferable molar ratio of the BDNPF/DNPBF/BDNPF contained in the plasticizer is in the range of 20~68%/28~50%/4~30%. The plasticizer of the present invention may further contain bis(2,2-dinitropropyl) diformal by less than 5%, preferably by less than 3%, and most preferably by less than 1%.

It was found that the plasticizer comprising the eutectic mixture of the above formulation has not been crystallized out at the temperature of −10~20° C.

The plasticizer may be obtained by reacting 2,2-dinitropropanol and 2,2-dinitrobutanol with formaldehyde source.

More particularly, the method for preparing the plasticizer of the invention comprises:

a) dissolving 2,2-dinitropropanol and 2,2-dinitrobutanol into an organic solvent to form an organic solution, in which the molar ratio of 2,2-dinitropropanol to 2,2-dinitrobutanol is 3:1–6:1;

b) adding to the organic solution a sulfuric acid solution where formaldehyde source was dissolved, wherein the temperature of reaction medium is maintained below 20° C.; and c) separating and purifying the product from the reaction mixture.

The preferable organic solvent used in the reaction is methylene chloride, but not limited thereto. And, the formaldehyde source includes, for example, paraformaldehyde or s-trioxane.

In the plasticizer comprising 3-components mixed-formal obtained by the above-described method, the composition of the BDNPF, DNPBF and BDNPF can be controlled in the range of 20~68/28~50/4~30% by suitable adjusting molar ratio of the starting materials, 2,2-dinitropropanol and 2,2-dinitrobutanol.

Most of all, the present invention is characterized in that the content of the diformal, the by-product, can be reduced by less than 5%, preferably by less than 3%, and most preferably by less than 1%.

Reaction of 2,2-dinitropropanol and 2,2-dinitrobutanol with formaldehyde is shown in scheme 1:

Scheme 1

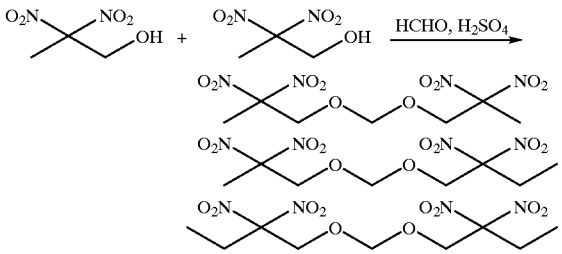

EXAMPLE

The following examples are offered to further illustrate the present invention, but the scope of the invention is not limited thereto.

Example 1

10.5 g (0.07 mole) of 2,2-dinitropropanol and 3.83 g (0.0233 mole) 2,2-dinitrobutanol were dissolved homogeneously into 13 mL of methylene chloride at a temperature of 20~30° C. 1.54 g (0.0513 mole) of s-trioxane was completely dissolved in 14.0 g of concentrated sulfuric acid solution, and then, this solution was injected to the methylene chloride solution using syringe pump, wherein temperature of the reaction solution was controlled not to exceed 20° C. After the addition was completed, the reaction solution was stirred for further 30 minutes. Upon completion of the reaction, the reaction solution was quenched with water. The reaction mixture was extracted with 130 mL of methylene chloride, and then, the extract was successively washed with 5% sodium hydroxide aqueous solution (130 mL×4) and saturated solution of sodium chloride (130 mL×2), dried over anhydrous magnesium sulfate, and then filtered. The filtrate was concentrated under reduced pressure. Further evaporation under 60° C., about 10 mmHg for 5 hours gave 11.13 g of mixed formals in which 4.8 mol % of diformal was contained (yield: 74.7%, when diformal is considered, 74.3%). The molar ratio of the mixed-formals was BDNPF/DNPBF/BDNBF=52.3/38.8/8.9%.

Example 2

12 g (0.08 mole) of 2,2-dinitropropanol and 3.28 g (0.02 mole) 2,2-dinitrobutanol were dissolved homogeneously into 13 mL of methylene chloride at a temperature of 0~10° C. 1.65 g (0.055 mole) of s-trioxane was completely dissolved in 14.0 g of concentrated sulfuric acid solution, and then, this solution was injected to the methylene chloride solution using syringe pump, wherein temperature of the reaction solution was controlled not to exceed 20° C. The remaining procedures were conducted in the same manner as described in the Example 1.

The amount of mixed formals obtained: 11.73 g

The amount of diformal contained in the mixed formals: 3.6 mol %

Yield: 74.0%, when diformal is considered, 73.0%

The molar ratio of the mixed-formals: BDNPF/DNPBF/BDNBF=58.2/35.2/6.6%

Example 3

13.5 g (0.09 mole) of 2,2-dinitropropanol and 2.95 g (0.018 mole) 2,2-dinitrobutanol were dissolved homogeneously into 13 mL of methylene chloride at a temperature of 0° C. 1.78 g (0.059 mole) of s-trioxane was completely dissolved in 16.2 g of concentrated sulfuric acid solution, and then, this solution was injected to the methylene chloride solution using syringe pump, wherein temperature of the reaction solution was controlled not to exceed 20° C. The remaining procedures were conducted in the same manner as described in the Example 1.

The amount of mixed formals obtained: 9.97 g

The amount of diformal contained in the mixed formals: 0.6 mol %

Yield: 58.8%, when diformal is considered, 58.5%

The molar ratio of the mixed-formals: BDNPF/DNPBF/BDNBF=61.9/32.9/5.2

Example 4

13.5 g (0.09 mole) of 2,2-dinitropropanol and 2.46 g (0.015 mole) 2,2-dinitrobutanol were dissolved homogeneously into 13 mL of methylene chloride at a temperature of 0° C., and 7.9 g of concentrated sulfuric acid was added thereto. 1.73 g (0.057 mole) of s-trioxane was completely dissolved in 7.9 g of concentrated sulfuric acid solution, and then, this solution was injected to the methylene chloride solution using syringe pump, wherein temperature of the reaction solution was controlled not to exceed 10° C. The remaining procedures were conducted in the same manner as described in the Example 1.

The amount of mixed formals obtained: 12.1 g

The amount of diformal contained in the mixed formals: 4.5 mol %

Yield: 73.5%, when diformal is considered, 73.4%

The molar ratio of the mixed-formals: BDNPF/DNPBF/BDNBF=67.9/27.8/4.3%

As so far described, the energetic plasticizer comprising the eutetic mixture of bis(2,2-dinitropropyl) formal, 2,2-dinitropropyl 2,2-dinitrobutyl formal and bis(2,2-dinitrobutyl) formal has the excellent thermal and chemical properties while incurring a low production cost. Especially, the energy content is heightened by minimizing the content of the diformal produced as a side product, so that it is favorably adapted for use in an insensitive high performance explosive and a propellant.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An energetic plasticizer comprising bis (2,2-dinitropropyl) formal, 2,2-dinitropropyl-2,2-dinitrobutyl formal, bis (2,2-dinitropropyl) formal and diformal, wherein the molar ratio between bis (2,2-dinitropropyl) formal, 2,2-dinitropropyl-2-,2-dinitrobutyl formal and bis (2,2-dinitropropyl) formal is 50–68%:28–40%:4–30%, respectively and the amount of diformal present is less than 5 mol % based on the plasticizer.

2. The energetic plasticizer according to claim 1 wherein diformal is present in less than 3 mol %.

3. The energetic plasticizer according to claim 2 wherein diformal is present in less than 1 mol %.

4. The energetic plasticizer according to claim 1 wherein the molar ratio of bis (2,2-dinitropropyl) formal, 2,2-dinitropropyl, 2,2-dinitrobutyl formal and bis (2,2-dinitropropyl) formal is 52.3–68%:28–38.8 and 4–30.

5. A method for synthesizing the plasticizer according to claim 1, comprising:

(a) dissolving 2,2-dinitropropanol and 2,2-dinitrobutanol into an organic solvent to form an organic solution, in which the molar ratio of 2,2-dinitropropanol to 2,2-dinitrobutanol is 4:1–6:1;

(b) adding to the organic solution a sulfuric acid solution in which a formaldehyde source is dissolved, wherein the temperature of the reaction medium is maintained below 20° C.; and (c) separating and purifying the product from the reaction mixture.

6. The method according to claim 5 wherein the formaldehyde source includes paraformaldehyde and s-trioxane.

* * * * *